US009757301B2

(12) United States Patent
Wu

(10) Patent No.: US 9,757,301 B2
(45) Date of Patent: Sep. 12, 2017

(54) AUTOMATIC MASSAGING APPARATUS

(71) Applicant: Dong-Her Wu, Changhua (TW)

(72) Inventor: Dong-Her Wu, Changhua (TW)

( * ) Notice: Subject to any disclaimer, the term of this patent is extended or adjusted under 35 U.S.C. 154(b) by 303 days.

(21) Appl. No.: 14/543,788

(22) Filed: Nov. 18, 2014

(65) Prior Publication Data

US 2015/0073320 A1 Mar. 12, 2015

(30) Foreign Application Priority Data

Jul. 17, 2014 (TW) ..... 103124640 A

(51) Int. Cl.

| | |
|---|---|
| ***A61H 7/00*** | (2006.01) |
| ***A61H 1/00*** | (2006.01) |
| ***A61H 39/04*** | (2006.01) |
| ***A61H 23/00*** | (2006.01) |
| ***A61H 23/02*** | (2006.01) |
| *A61H 15/00* | (2006.01) |

(52) U.S. Cl.

CPC ..... *A61H 1/00* (2013.01); *A61H 7/004* (2013.01); *A61H 23/004* (2013.01); *A61H 23/0254* (2013.01); *A61H 39/04* (2013.01); *A61H 2015/0014* (2013.01); *A61H 2201/0138* (2013.01); *A61H 2201/1215* (2013.01); *A61H 2201/1418* (2013.01); *A61H 2201/1481* (2013.01); *A61H 2201/1669* (2013.01); *A61H 2201/1676* (2013.01); *A61H 2201/1678* (2013.01)

(58) Field of Classification Search

CPC ..... A61H 7/00; A61H 7/003; A61H 7/004; A61H 7/007; A61H 2007/009; A61H 11/02; A61H 2201/0134; A61H 2201/0138; A61H 2201/0142; A61H 2201/0146; F16H 19/0622; F16H 19/0631; F16H 2019/0627

See application file for complete search history.

(56) References Cited

U.S. PATENT DOCUMENTS 4,973,291 A * 11/1990 Mottate ..... F16C 29/04 384/49
5,165,390 A * 11/1992 Fleetwood ..... A61H 1/00 601/116

(Continued)

FOREIGN PATENT DOCUMENTS

TW M371014 12/2009

*Primary Examiner* — Justine Yu
*Assistant Examiner* — Kathrynn Lyddane
(74) *Attorney, Agent, or Firm* — Che-Yang Chen; Law Offices of Scott Warmuth

(57) ABSTRACT

An automatic massage apparatus may include a main body, a massaging unit, at least two first belts and at least two second belts. The main body has a guiding rail that is hollow to provide a space for a driving unit of the massaging unit, and a long groove is formed on both sides of the guiding rail. The massaging unit has a driving unit that has a driving shaft extending towards both sides of the driving unit. Both ends of the driving shaft have a plurality of wheels disposed against the rail of the main body, and these wheels are appropriately spaced. Both sides of the massaging unit have at least one compartment and a second compartment. One end of the first belt is secured on the first end of the positioning unit, and the other end is wrapping the driving shaft in the first compartment.

5 Claims, 10 Drawing Sheets

(56) References Cited

U.S. PATENT DOCUMENTS

| | | | | |
|---|---|---|---|---|
| 5,792,080 | A * | 8/1998 | Ookawa | A61H 1/00 601/102 |
| 6,840,914 | B1 * | 1/2005 | Takamura | A61H 15/0078 601/102 |
| 6,991,609 | B2 * | 1/2006 | Kan | A61H 7/007 601/100 |
| 2002/0193713 | A1 * | 12/2002 | Lee | A61H 15/0078 601/99 |
| 2008/0077060 | A1 * | 3/2008 | Liang | A61H 7/007 601/99 |
| 2008/0077061 | A1 * | 3/2008 | Dehli | 601/118 |
| 2010/0030121 | A1 * | 2/2010 | Fu | A61H 15/0078 601/99 |
| 2011/0082400 | A1 * | 4/2011 | Wu | 601/99 |
| 2011/0218465 | A1 * | 9/2011 | Yang | A61H 1/00 601/18 |

* cited by examiner

AUTOMATIC MASSAGING APPARATUS

FIELD OF THE INVENTION

The present invention is related to an automatic massaging apparatus, and more particularly to an automatic massaging apparatus that is unlikely to slip so the momentum can be efficiently transmitted.

BACK GROUND OF THE INVENTION

As shown in FIGS. 8 to 10, the massaging apparatus may include a restricting frame (50) and a massaging unit (60), wherein the restricting frame (50) is curved along with the curvature of the leg, and one end of which has an open portion (51) to receive the legs of the user, and the other end is bent upwards to form a stopping edge (52) and a sliding rail (53). A rail (54) is formed between two sliding rails (53) and the rail (54) is actually lower than the sliding rails (53). A protruding portion (55) is formed at an upper surface of the restricting frame (50) and a sliding groove (56) is formed near the protruding portion (55). The massaging device (60) has a driving unit (61) and a shaft (62) inserted through the driving unit (61). A massaging unit (63) is disposed on both ends of the shaft (62). The massaging unit (63) may include an arm (631) and massaging wheels (632), which are disposed at a front and rear portion of the arm (631), and a protruding block (611) is formed at the bottom of the driving unit (61). The shaft (62) has a wheel (64) and a shaft (65), which are secured at one side of the shaft (62) along with the massaging unit (63) to be driven by the shaft (62). According to the structure stated above, the protruding block (611) is used to engage with the sliding groove (56) of the restricting frame (50), the wheel (64) is disposed against the rail (54), and the shaft (65) can be slid into the sliding rail (53), so the entire massaging unit (60) can be disposed into the open portion (51) of the restricting frame (50). Meanwhile, the upper portion of the shaft (65) and the lower portion of the wheel (64) can be seamlessly contacted with the top portion of the sliding rail (53) and the rail (54) to generate a braking effect. When the driving unit (61) is activated, it can drive the shaft (62) to further drive the massaging unit (63) and wheel (64).

However, the friction between the wheel (64) and rail (54) may not be sufficient to drive the massaging device (60). Namely, the momentum cannot be efficiently transmitted, so the wheel (64) and the massaging device (60) may slip easily at their original positions. Therefore, there remains a need for a new and improved massaging apparatus to overcome the problems stated above.

SUMMARY OF THE INVENTION

To solve the problems stated above, the present invention provides an automatic massage apparatus may include a main body, a massaging unit, at least two first belts and at least two second belts. The main body has a first end and a second end, and a positioning unit horizontally disposed on the first end and second end, so the positioning unit can be provided to secure one end of the first belt and second belt. An inner-curved cover is disposed on both sides of the main body and a rail is disposed underneath the cover and aligned with the top surface of the main body. The main body has a guiding rail extending towards the direction of the first end and second end. The guiding rail is hollow to provide a space for a driving unit of the massaging unit, and a long groove is formed on both sides of the guiding rail. The massaging unit has a driving unit that has a driving shaft extending towards both sides of the driving unit. When the driving unit is disposed into the space of the guiding rail, the long groove is used provided for the extension of the driving shaft, so the driving unit can be connected to an eccentric massaging body through the driving shafts. Furthermore, both ends of the driving shaft have a plurality of wheels disposed against the rail of the main body, and these wheels are appropriately spaced. Both sides of the massaging unit have at least one compartment and a second compartment. One end of the first belt is secured on the first end of the positioning unit, and the other end is wrapping the driving shaft in the first compartment. Likewise, one end of the second belt is secured on the second end of the positioning unit, and the other end is wrapping the driving shaft in the second compartment.

The present invention is advantageous because (1) with the arrangement of the first belt and second belt, the massaging unit is pulled on one end and released from the other end to avoid the massaging unit slipping because of the wheel to ensure the momentum is transmitted, and (2) with the arrangement of the first belts and second belts, the structure of the massaging apparatus is simplified.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
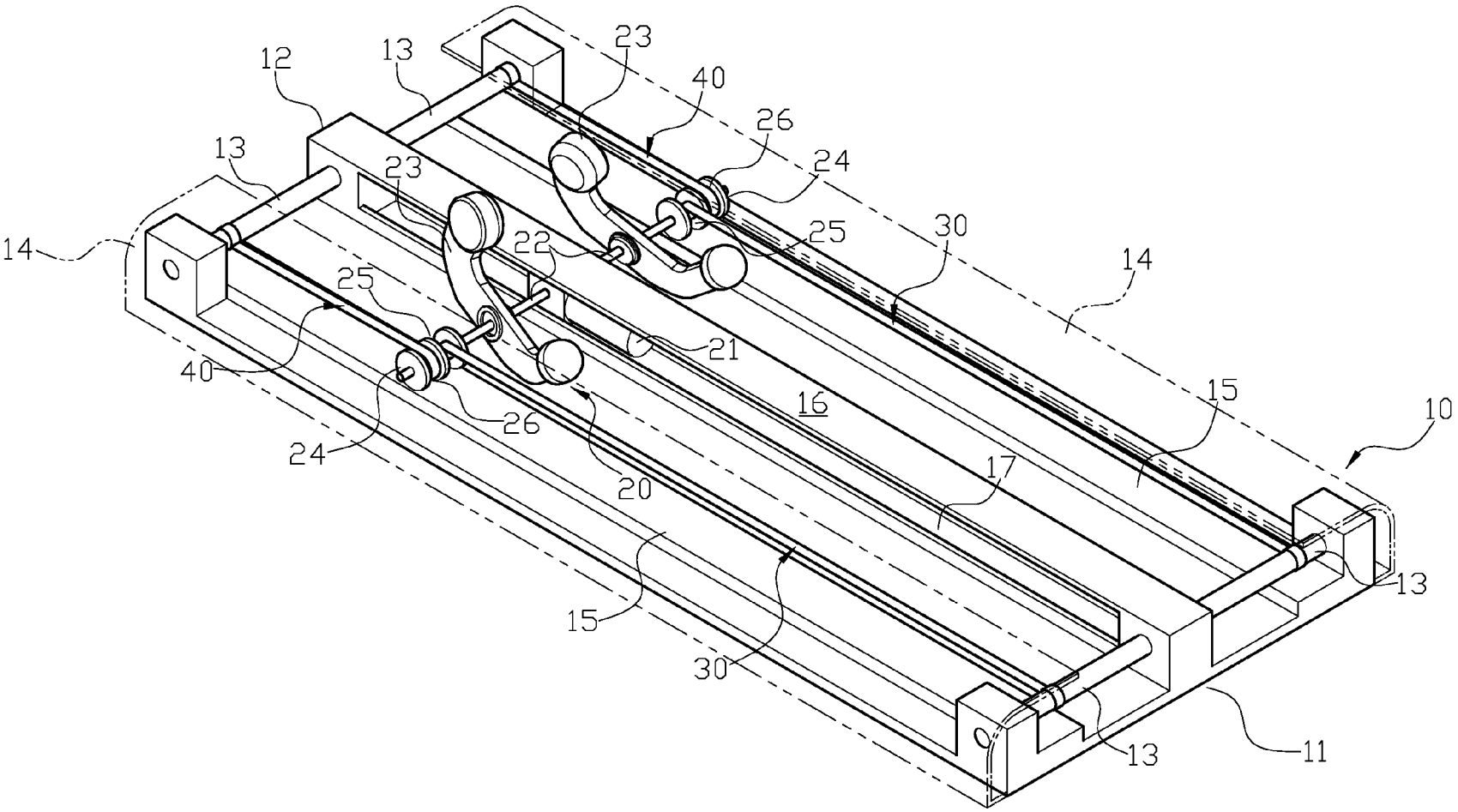
FIG. 1 illustrates a three-dimensional view of the basket in the present invention.

In order to further understand the goal, characteristics and effect of the present invention, a number of embodiments along with the drawings are illustrated as following:

Referring to FIG. 1, an automatic massage apparatus may include a main body (10), a massaging unit (20), at least two first belt (30) and at least two second belt (40). The main body (10) has a first end (11) and a second end (12), and a positioning unit (13) horizontally disposed on the first end (11) and second end (12), so the positioning unit (13) can be provided to secure one end of the first belt (30) and second belt (40). An inner-curved cover (14) is disposed on both sides of the main body (10) and a rail (15) is disposed underneath the cover (14) and aligned with the top surface of the main body (10). The main body (10) has a guiding rail (16) extending towards the direction of the first end (11) and second end (12). The guiding rail (16) is hollow to provide a space for a driving unit (21) of the massaging unit (20), and a long groove (17) is formed on both sides of the guiding rail (16). The massaging unit (20) has a driving unit (21) that has a driving shaft (22) extending towards both sides of the driving unit (21). When the driving unit (21) is disposed into the space of the guiding rail (16), the long groove (17) is used provided for the extension of the driving shaft (22), so the driving unit (21) can be connected to an eccentric massaging body (23) through the driving shafts (22). Furthermore, both ends of the driving shaft (22) have a plurality of wheels (24) disposed against the rail (15) of the main body (10), and these wheels (24) are appropriately spaced. Both sides of the massaging unit (20) have at least one compartment (25) and a second compartment (26). The first and second belts (30, 40) are flat. One end of the first belt (30) is secured on the first end (11) of the positioning unit (13), and the other end is wrapping the driving shaft (22) in the first compartment (25). Likewise, one end of the second belt (40) is secured on the second end (12) of the positioning unit (13), and the other end is wrapping the driving shaft (22) in the second compartment (26).

Figure 2:
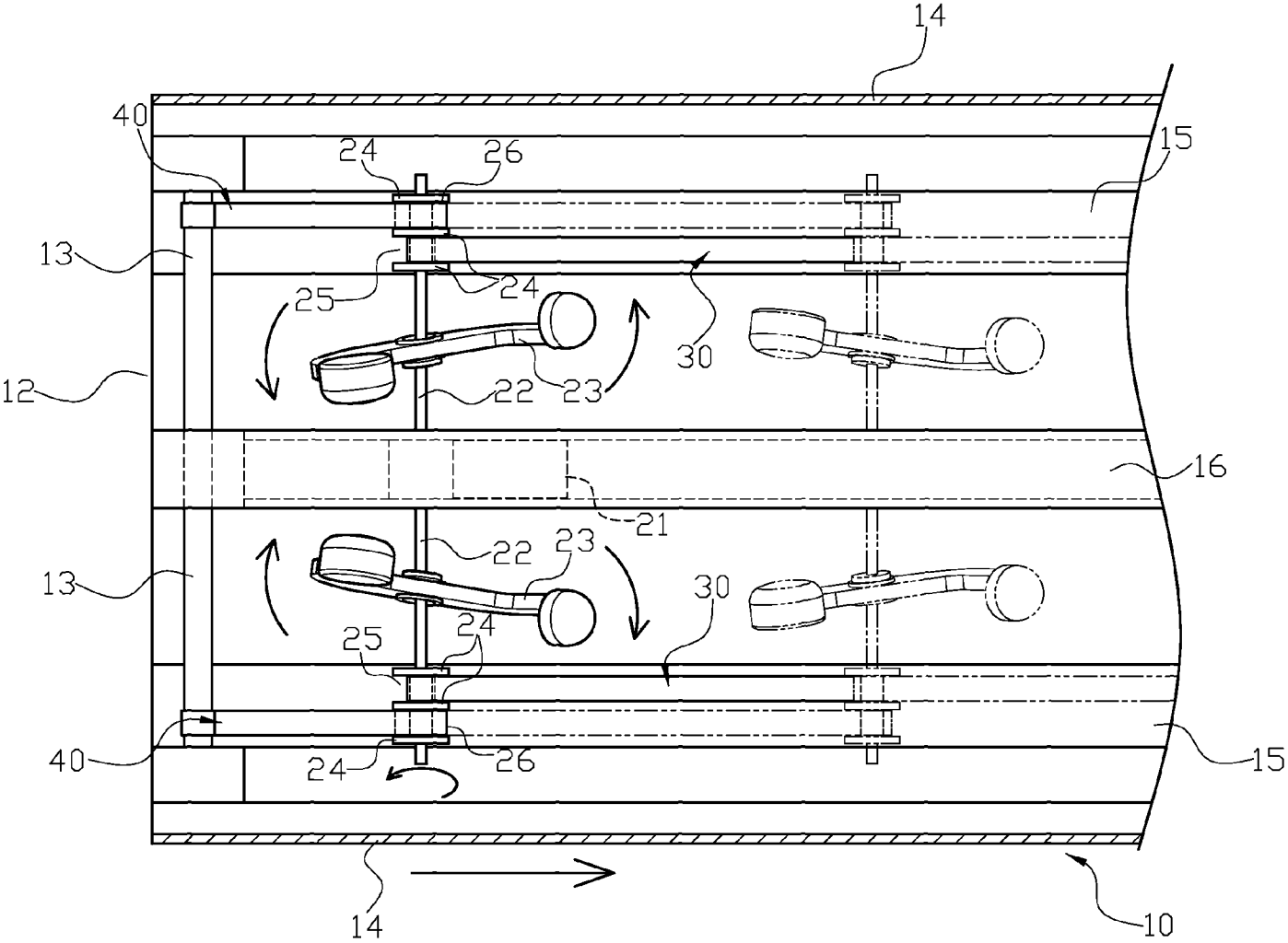
FIG. 2 illustrates the first embodiment of the present invention.
Figure 3:
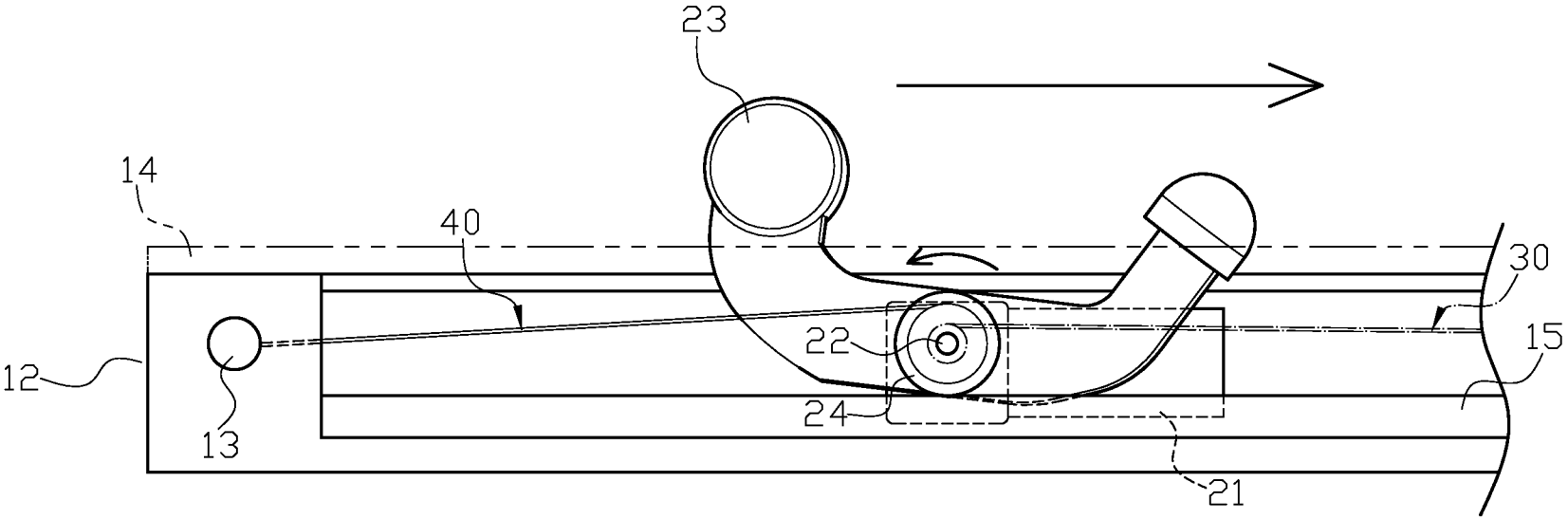
FIG. 3 illustrates the first embodiment of the present invention of a different angle.

When in use, the massaging unit (20) is turned on, so the eccentric massaging body (23) is driven through the driving unit (21) and the driving shaft (22) to massage the human body. With the rotation of the driving shaft (22), the wheels (24) are rotating on the rail (15) and the entire massaging unit (20) can be moved toward the first end (11) or second end (12). Also through the first belt (30) and second belt (40), the massaging unit (20) is unlikely to slip so the momentum can be actually transmitted. Namely, when the massaging unit (20) is moving towards the first end (11) (see FIGS. 2 and 3), the first belt (30) will be tightened while the second belt (40) will be loosened to utilize the tension of the first belt (30) to drive the massaging unit (20) toward the direction of the first end (11). Conversely, when the massaging unit (20) is moving towards the second end (12), the second belt (40) will be tightened while the first belt (30) will be loosened.

Figure 4:
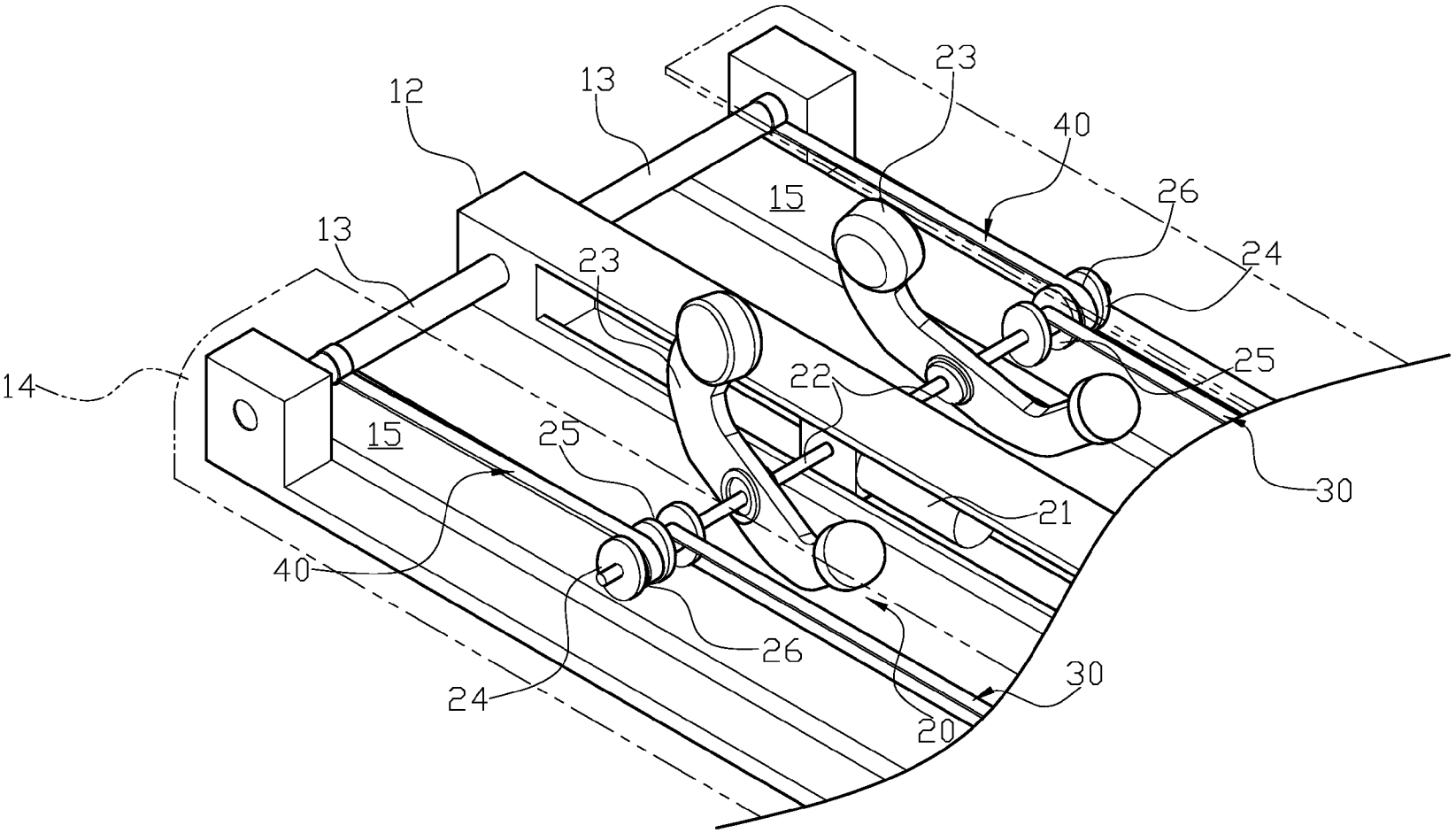
FIG. 4 illustrates a three-dimensional view of the second embodiment in the present invention.
Figure 5:
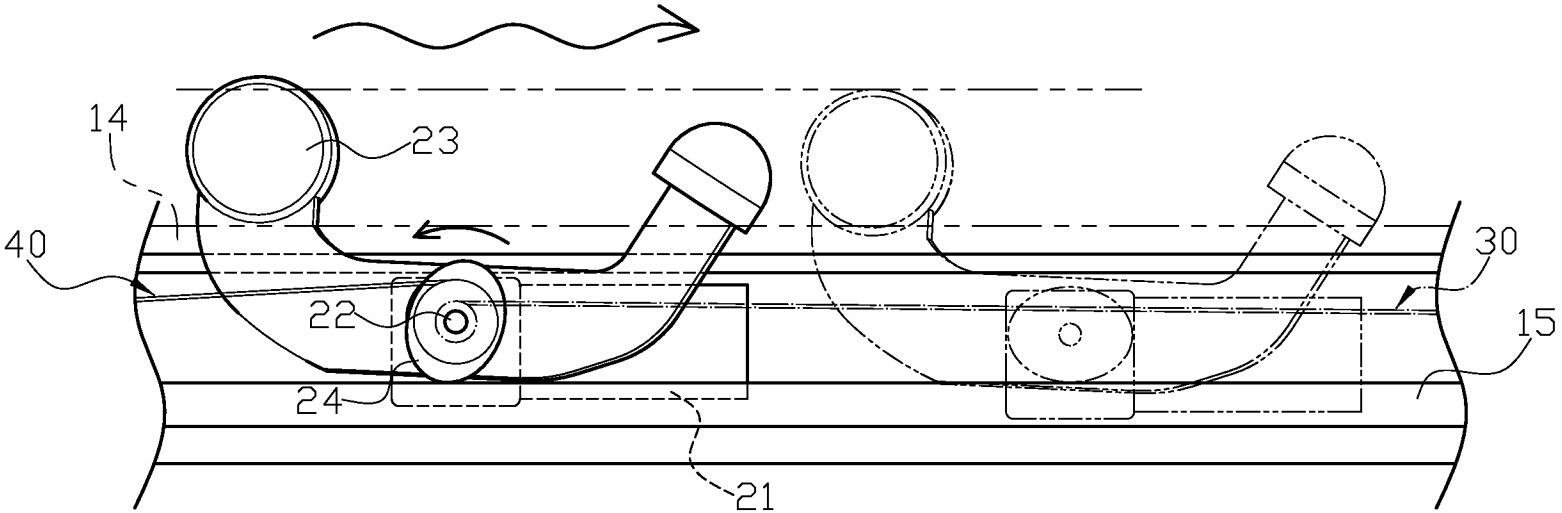
FIG. 5 illustrates a action view of the second embodiment in the present invention.

In one embodiment, the wheel (24) is round. In another embodiment, the wheel (24) is oval-shaped (see FIGS. 4 and 5). Utilizing the difference between the long and short axes of the oval-shaped wheel, the wheel (24) can roll on the rail (15) in a high-low manner to provide a different massaging effect.

In still another embodiment, the main body (10), rail (15) and guiding rail (16) are arranged horizontally, so the massaging unit (20) can move linearly.

Figure 6:
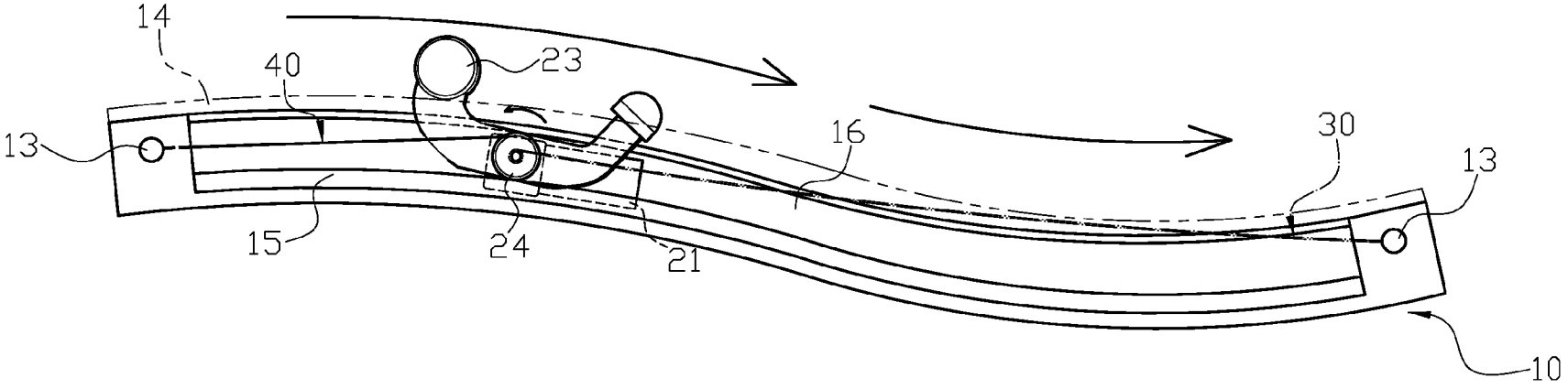
FIG. 6 illustrates a third embodiment of the present invention.

In a further embodiment, the main body (10), rail (15) and guiding rail (16) are arranged according to the body shape (see FIG. 6), so the massaging unit (20) can move along the curved main body (10).

In still a further embodiment, the rail (15) is protruding from the upper surface of the main body (10).

Figure 7:
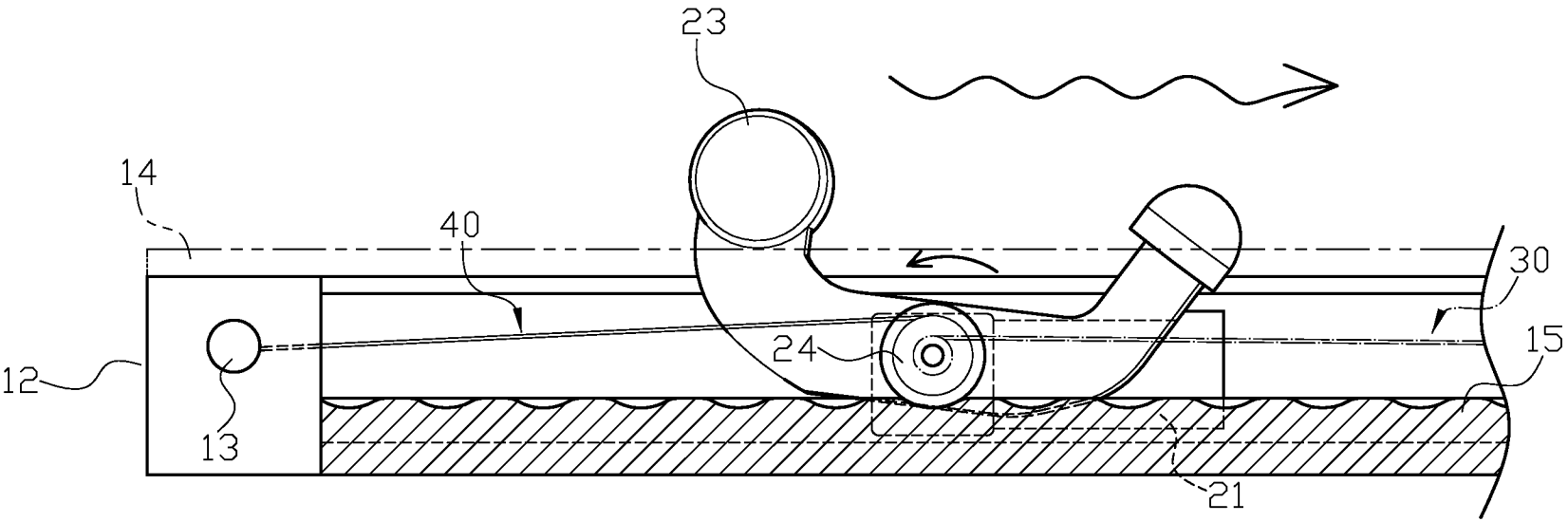
FIG. 7 illustrates a fourth embodiment of the present invention.
Figure 8:
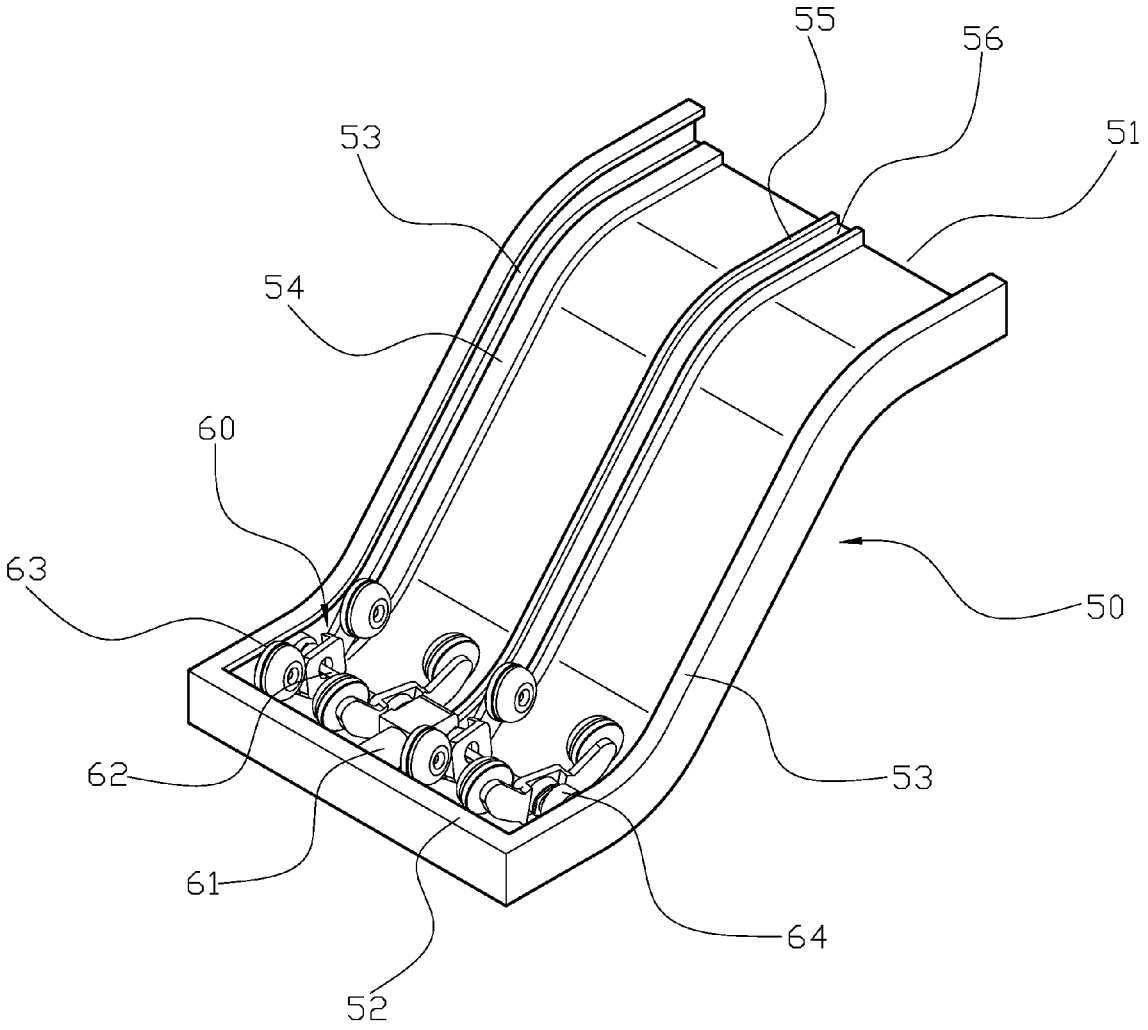
FIG. 8 PRIOR ART
FIG. 8 illustrates a three-dimensional view of the prior art.
Figure 9:
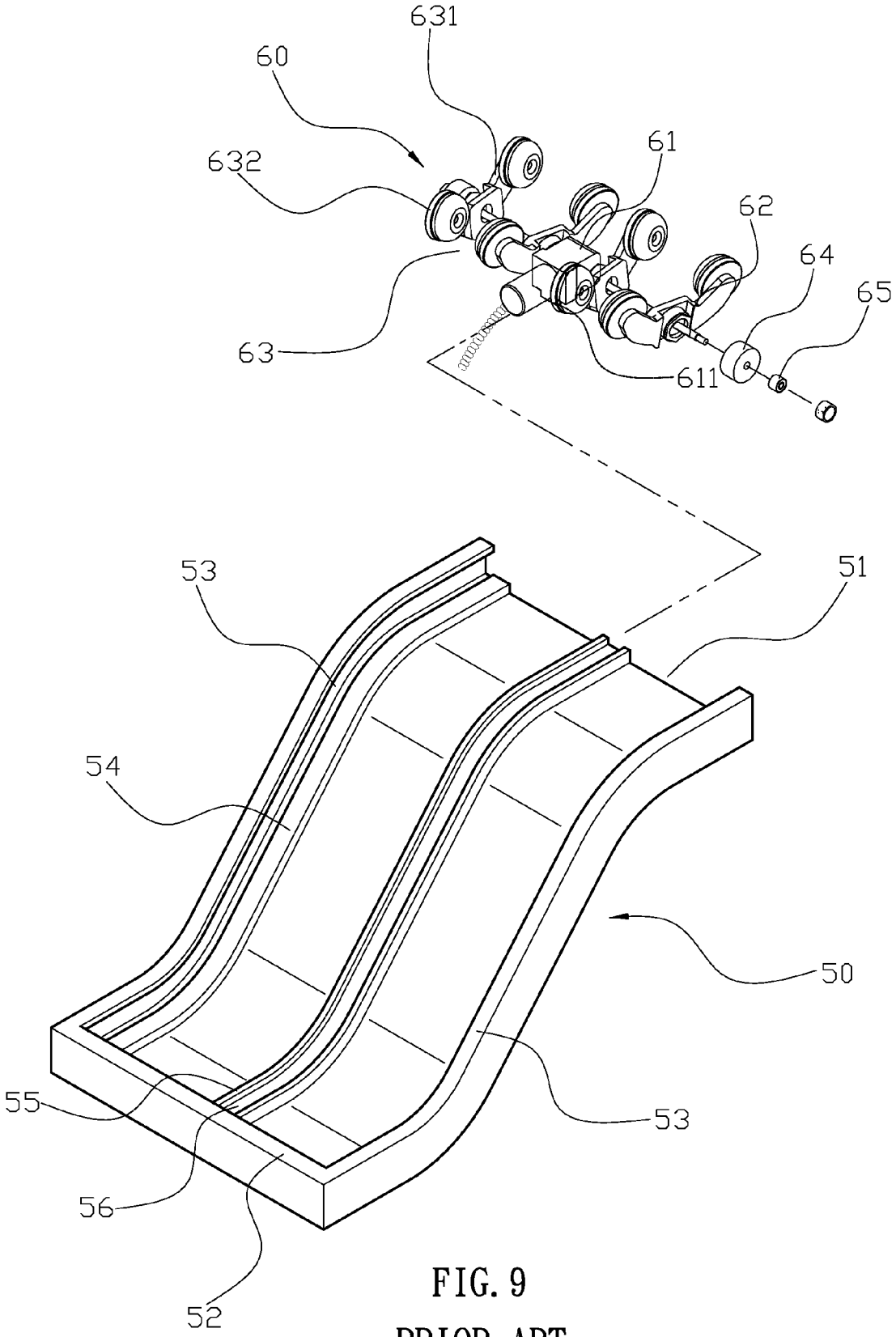
FIG. 9 PRIOR ART
FIG. 9 illustrates a three-dimensional exploded view of the prior art.
Figure 10:
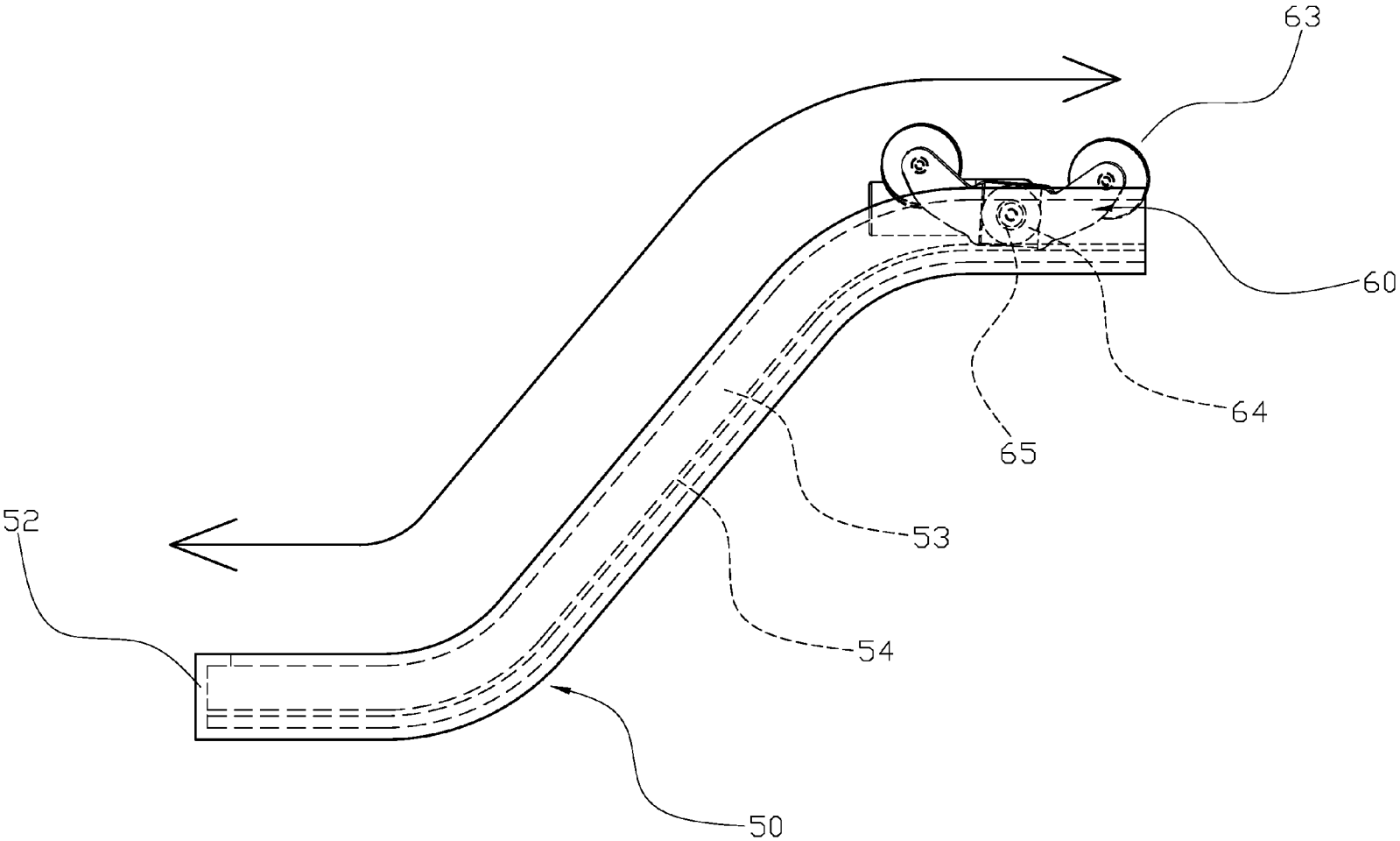
FIG. 10 PRIOR ART
FIG. 10 illustrates an action view of the prior art.

In still a further embodiment, the surface of the rail (15) is wavy and when the massaging unit (20) is rolling on the rail (15), it can generate a vibrating effect (see FIG. 7). Also, the top portion of the guiding rail (16) is detachable, so it can be closed after the driving unit (21) is disposed therein.

According to the embodiments mentioned above, the present invention is advantageous because (1) with the arrangement of the first belt (30) and second belt (40), the massaging unit (20) is pulled on one end and released from the other end to avoid the massaging unit (20) slipping because of the wheel (24) to ensure the momentum is transmitted, and (2) with the arrangement of the first belt (30) and second belt (40), the structure of the massaging apparatus is simplified.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An automatic massage apparatus comprising: a main body, a massaging unit, at least two first belts and at least two second belts, wherein the main body has a first end, a second end, a first lateral side and a second lateral side; and a positioning unit is horizontally disposed on each of the first end and second end; and an inner-curved cover is disposed on each of the first lateral side and second lateral side of the main body and a rail is disposed underneath the cover and aligned with a top surface of the main body; and the main body has a guiding rail extending between the first end and second end, and the guiding rail is hollow to provide a space for a driving unit of the massaging unit, and a long groove is formed on each of two lateral sides of the guiding rail, wherein the driving unit has a driving shaft extending from the driving unit towards the first lateral side and second lateral side from each end of the driving shaft, and when the driving unit is disposed into the space of the guiding rail, the driving unit is configured to connect to an eccentric massaging body through the driving shaft; both ends of the driving shaft have a plurality of wheels spacedly disposed against the rail of the main body, and both sides of the massaging unit have at least a first compartment and a second compartment, wherein one end of each of the first belts is secured on the positioning unit at the first end of the main body, and the other end of each of the first belts is configured to wrap the driving shaft in the first compartment, wherein one end of each of the second belt is secured on the positioning unit at the second end of the main body, and the other end of each of the second belts is configured to wrap the driving shaft in the second compartment.

2. The automatic massage apparatus of claim 1, wherein the first and second belts are flat.

3. The automatic massage apparatus of claim 1, wherein the wheels are round.

4. The automatic massage apparatus of claim 1, wherein the wheels are oval-shaped, and a massaging effect is generated by utilizing the differences between two axes of each of the oval-shaped wheels.

5. The automatic massage apparatus of claim 1, wherein a surface of the rail is wavy.

* * * * *